United States Patent [19]

Holland-Letz

[11] 4,187,778

[45] Feb. 12, 1980

[54] APPARATUS FOR PRINTING AND DISPENSING LABELS

[75] Inventor: Günter Holland-Letz, Hirschhorn, Fed. Rep. of Germany

[73] Assignee: Dymo Industries, Inc., San Francisco, Calif.

[21] Appl. No.: 882,627

[22] Filed: Feb. 28, 1978

[30] Foreign Application Priority Data

Mar. 1, 1977 [DE] Fed. Rep. of Germany ..... 2708728

[51] Int. Cl.[2] ..... B41F 1/08

[52] U.S. Cl. ..... 101/291; 101/288; 156/384

[58] Field of Search ..... 101/287, 288; 156/291, 156/292, 384

[56] References Cited

U.S. PATENT DOCUMENTS

| | | | |
|---|---|---|---|
| 3,024,728 | 3/1962 | Angus | 101/110 |
| 3,705,833 | 12/1972 | Wada | 101/292 |
| 4,057,452 | 11/1977 | Sako | 101/288 |
| 4,072,105 | 2/1978 | Becker et al. | 101/288 |

*Primary Examiner*—William Pieprz

*Attorney, Agent, or Firm*—Gerald J. Ferguson, Jr.; Joseph J. Baker

[57] ABSTRACT

The invention relates to an apparatus for printing, keeping in readiness and applying labels of a label strip, having a transport device for the stepwise advancement of the label strip, and associated therewith an inking device, a hand lever held in a braced position by a return spring and having a printer handle, which is pivotally supported and co-operates with the hand lever and with which the printer, the inking device and the transport device are coupled and which has an abutment face which is maintained contiguous to an abutment of the hand lever and the printer lever. The pivot axis of the printer lever is arranged between the pivot axis and the abutment of the hand lever in the vicinity of the pivot axis of the hand lever.

7 Claims, 4 Drawing Figures

APPARATUS FOR PRINTING AND DISPENSING LABELS

The invention relates to apparatus for printing and dispensing labels of a label strip, having a transport device for the stepwise advancement of the label strip appropriate to its division, in the course of each operating cycle, a printing table over which the label strip is conducted, a printer which is arranged for movement with respect to the printing table and having associated therewith an inking device, a hand lever held in a braced position by a return spring and having a printer handle which is pivotally supported and co-operates with the hand lever in the same sense in the pivotal plane of the hand lever and with which the printer, the inking device and the transport device are coupled and which has an abutment face which is maintained contiguous to an abutment of the hand lever by a spring arranged between the hand lever and the printer lever.

Such an appliance is known from the German Offenlegungsschrift 2 345 249. In this known appliance the movement of the printer towards the printing table takes place during the pivoting of the hand lever. The printer lever moves the printer towards the printing table when the force of the spring which is arranged between the hand lever and the printer lever exceeds the resistance which opposes movement of the printer lever. The inking device consists of a pivot member at the free end of which an inking pad is provided. A return spring presses the pivot member with the inking pad from below against the printing type faces. During the printing operation the printer pushes the inking pad and the pivot member of the inking device out of its movement path against the action of the return spring. Since a spring is provided between the hand lever and the printer lever, which is capable of being stressed to a spring force which is larger than the resistance opposing the movement of the printer towards the printing table, the printer becomes independent of the force and the speed with which the hand lever is pivoted at a force which remains constant throughout towards the printing table and the label to be printed, respectively.

However, the known appliance has the disadvantage that the length of the labelling appliance is relatively large, because on the one hand the length and the pivot angle of the hand lever are largely determined by ergometric considerations and the length of the second printer lever is predetermined by the requirement for an adequate stroke height of the printer. The length of the printer lever is large particularly in the case of appliances in which the inking takes place from below and having multi-line printers, and in the case of appliances operating with an inking pad of large volume or a large inking roller in the inking device.

The object of the invention is to reduce the length of the structure of a labelling appliance of the kind hereinbefore mentioned.

In accordance with the invention, this object is fulfilled by arranging the pivot axis of the printer lever between the pivot axis and the abutment of the hand lever in the vicinity of the pivot axis of the hand lever.

What is accomplished by the measures in accordance with the invention is that the pivot angle of the printer lever is increased relative to the pivot angle of the hand lever, so that for any given stroke height of the printer the length of the printer lever may be reduced. The length of the structure of the labelling device, and hence also its weight, can be considerably reduced. Moreover, for any given dimensions of the length of the printer lever and for the required pivot angle of this lever, the pivot angle of the hand lever can be so chosen that it can be adapted to the anatomical and ergometric conditions in optimum manner.

Advantageously the two pivot axes are arranged in a plane which substantially extends through the line bisecting the pivot angles of the abutment faces.

In a preferred embodiment the axis of the second lever is formed by two disc-like axis members of larger diameter, whilst the axis of the hand lever is formed by a spindle which is of smaller diameter and arranged radially displaced between the disc-like axis members and which connects the latter.

Further features of the invention are apparent from the sub-claims.

In the following description an embodiment of the invention is explained in greater detail with reference to the drawings, in which.

Figure 1:
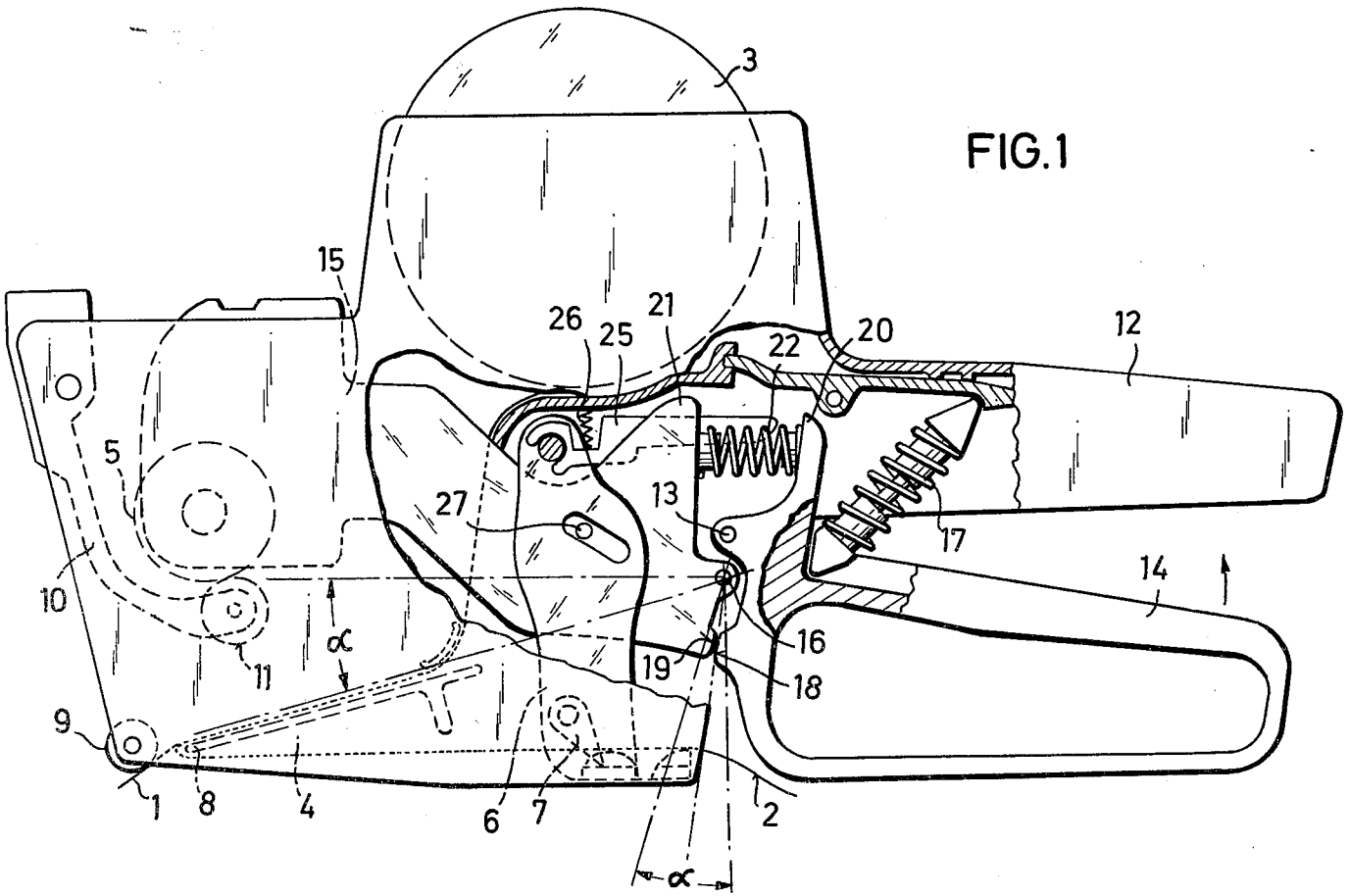
FIG. 1 is a side view of the labelling appliance according to the invention.

By means of the appliance shown in FIG. 1, self-adhesive labels 1 which are arranged in a row adherent to a carrier strip 2, are printed on the way from the label supply roll 3 to the label dispensing station by means of a printer 5 which is movable towards the printing table 4 and, for the purpose of detaching the labels 1, the carrier strip 2 is drawn stepwise around a diverting device 8 by means of a transporting device consisting of a transporting pivot member 6 with a clamping member 7 pivoted thereto. The label 1 which is in its dispensing position, printed and largely detached from the carrier strip 2 is still gently held by its rear edge, whilst its front edge is disposed beneath a pressure roller 9, by means of which it can be pressed and rolled on to an article to be labelled. The printer 5 is inked by an inking device which comprises a pivot member 10 which is subjected to the action of a return spring and at the free end of which a roller-shaped inking pad 11 is provided. The labelling appliance has a rigid handle 12 with respect to which a hand lever 14 is pivotable about an axis 13. The printer 5 is supported by a second lever 15, which is supported for pivoting about an axis 16, parallel to the axis 13 of the hand lever 14. A return spring 17, arranged between the hand lever 14 and the handle 12, pushes the hand lever 14 and, via the abutment faces 18 and 19 of the two levers 14 and 15, the second lever 15 and the transport pivot member 6 into the initial position shown in FIG. 1.

Above their pivot axis 13, the two levers 14 and 15 have mutually facing lever arms 20 and 21, between which a compression spring 22 is provided. This spring 22 pushes the lever 15, with the abutment face 19 disposed beneath the pivot axes 13 and 16, against the abutment 18 of the hand lever 15. Upon pivoting of the hand lever 14, the compression spring 22 is compressed, because a latch 25, which is held by a spring 26 in the latching position, prevents pivoting of the lever 15 towards the printing table 4 until, after the hand lever has pivoted to a predetermined extent, the latter raises the latch 25 out of its latching position. At this moment the spring 22 pushes the second lever 15 with the printer 5 against the printing table 4 and simultaneously the transport pivot member 6 is moved into a gripping position via a follower pin 27 which is guided in an oblique slot.

The two pivot axes 13 and 16 of the hand lever 14 and of the printer lever are disposed in a plane 24, which lies on the line bisecting the pivot angle $\alpha$ of the abutment face 19 of the second lever, which is shown below the appliance of FIG. 1. The second lever 15 also pivots through the angle $\alpha$ as the printer 5 moves toward printing table 4, this also being shown in FIG. 1.

Figure 2:
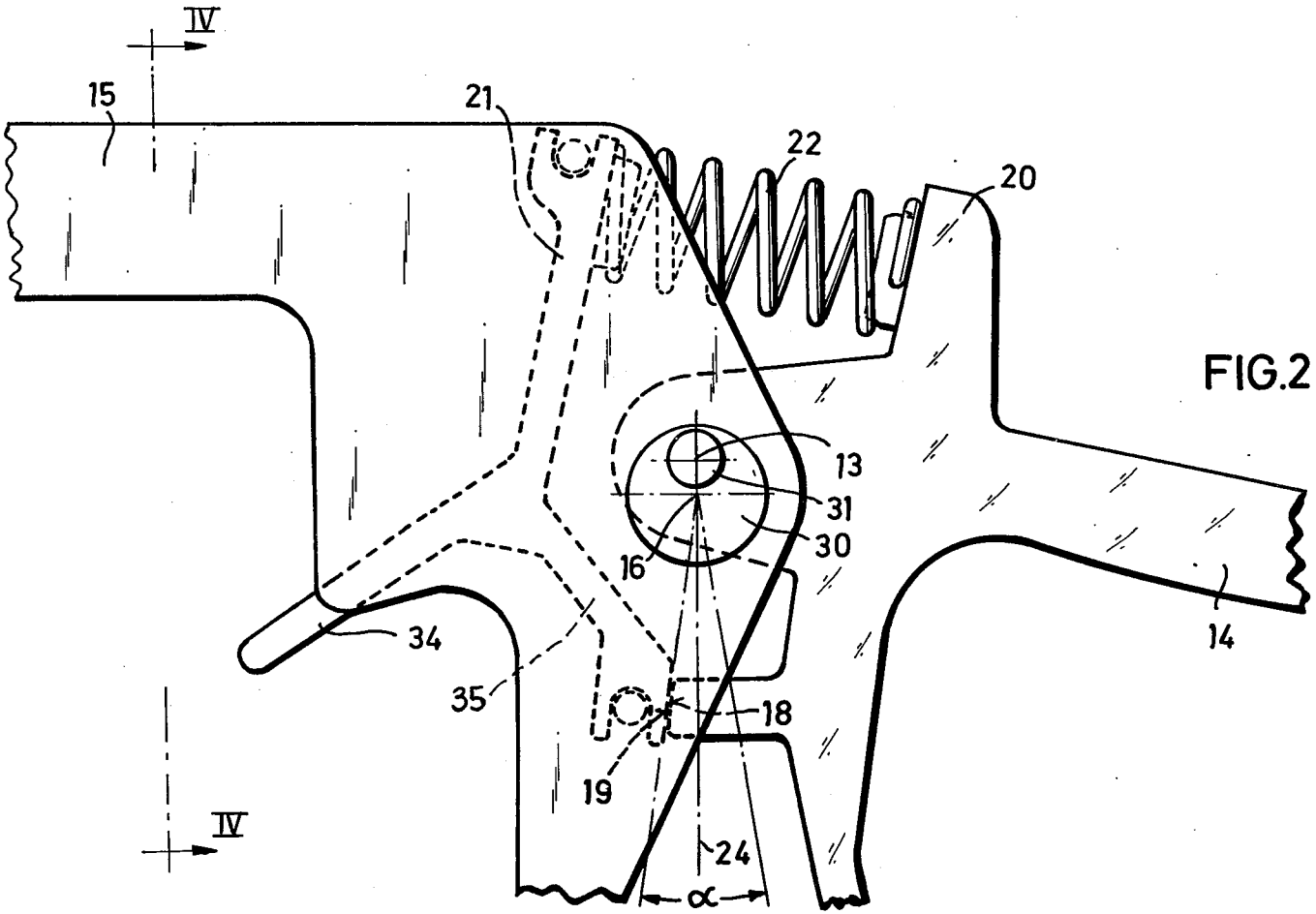
FIG. 2 is an enlarged side view of the bearing arrangement of the hand lever and of the second lever.
Figure 3:
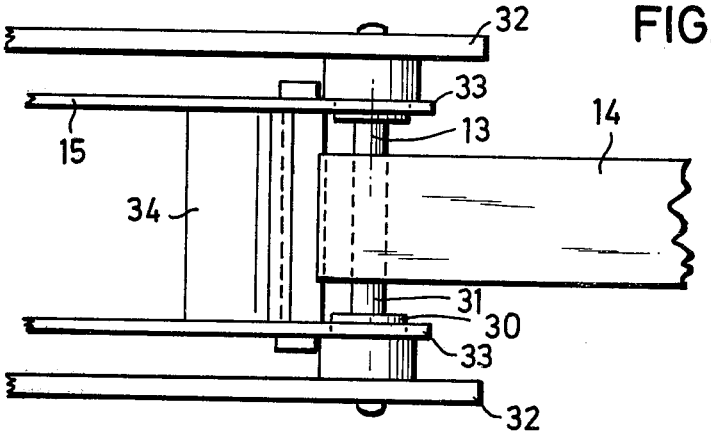
FIG. 3 is a plan view onto the bearing of the hand lever and of the second lever.
Figure 4:
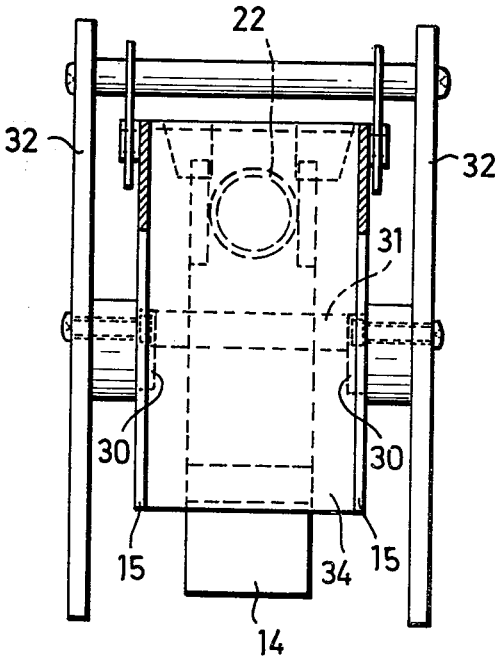
FIG. 4 is a view on the section line IV—IV in FIG. 2.

In the embodiments shown in FIGS. 2, 3 and 4 the pivot axis 16 of the printer lever is formed by two disc-like axis members 30 which are secured to the housing side walls 32, i.e. retained in bearing eyes in the housing side walls 32. Between the disc-like axis members 30 a spindle 31 of thinner diameter is secured, which forms the pivot axis 13 of the hand lever 14. The spindle 31 is radially downwardly displaced with respect to the axis members 30 such that the circumferential line of the spindle 31 is contiguous to the circumferential line of the axis members 30. The printer lever 15 is bifurcated in the region of its pivot axis 16 and the bearing eyes which embrace the axis members 30 are worked into the bifurcated walls 33.

The bifurcated walls 33 are rigidly interconnected by a connector 34. The connector is of Y-shaped cross-section and the abutment face 19 is provided on its limb 35.

LIST OF REFERENCE NUMERALS

| | |
|---|---|
| 1 Labels 1 | 17 Return spring |
| 2 Support strip | 18 Abutment |
| 3 Label supply roll | 19 Abutment face |
| 4 Printing table | 20 Lever arm |
| 5 Printer | 21 Lever arm |
| 6 Transport pivot member | 22 Spring |
| 7 Clamping member | |
| 8 Diverting device | 24 Plane of axes 13, 16 |
| 9 Pressure roller | 25 Latch |
| 10 Inking pivot member | 26 Spring |
| 11 Ink pad | 27 Follower pin |
| 12 Handle | 30 Axis member |
| 13 Pivot axis | 31 Spindle |
| 14 Hand lever | 32 Housing side walls |
| 15 Lever | 33 Bifurcated walls |
| 16 Pivot axis | 34 Connector |
| | 35 Limb |

I claim:

1. Apparatus for printing and dispensing labels of a label strip, having (a) a transport device for the stepwise advancement of the label strip in the course of each operating cycle, (b) a printing table over which the label strip is conducted, (c) a printer which is arranged for movement with respect to the printing table and having associated therewith an inking device, (d) a hand lever pivotable about a pivot axis held in a braced position by a return spring, (e) a printer lever, which pivots through a predetermined angle in response to pivotal movement of the hand lever against said return spring, (f) the printer rigidly secured to the said printer lever, the inking device and the transport device being operationally connected to said printer lever, and (g) said printer lever having an abutment face which is maintained contiguous to an abutment face of the hand lever by a second spring arranged between the hand lever and the printer lever, whereby motion of said hand lever against said return spring is transmitted to said printer lever via said second spring to thereby move the printer towards the printing table as said printing lever is pivoted through said predetermined angle, wherein the improvement comprises the pivot axis of the printer lever being disposed between the pivot axis and the abutment of the hand lever when it is in its braced position, said printer lever pivot axis being in the closer to of the pivot axis of the hand lever than to the abutment whereby the angle through which the printer rotates is greater than the angle through which the hand lever rotates for a given angle of hand lever rotation.

2. Apparatus according to claim 1 where said abutment face of the printer lever also pivots through said predetermined angle in response to pivotal movement of the hand lever and where the pivot axes of the hand lever and of the printer lever are arranged in a plane which substantially bisects the predetermined angle through which the abutment fact of the printer lever pivots.

3. Apparatus according to claim 2 where the said plane extends substantially at right angles to the longitudinal orientation of the hand lever and of the printer lever.

4. Apparatus for printing and dispensing labels of a label strip, having (a) a transport device for the stepwise advancement of the label strip in the course of each operating cycle, (b) a printing table over which the label strip is conducted, (c) a printer which is arranged for movement with respect to the printing table and having associated therewith an inking device, (d) a hand lever about a pivot axis held in a braced position by a return spring, (e) a printer lever, which pivots through a predetermined angle in response to pivotal movement of the hand lever against said return spring, and (f) the printer, the inking device and the transport device being coupled to said printer lever, (g) said printer lever having an abutment face which is maintained contiguous to an abutment face of the hand lever by a second spring arranged between the hand lever and the printer lever, whereby motion of said hand lever against said return spring is transmitted to said printer lever via said second spring to thereby move the printer towards the printing table as said printing lever is pivoted through said predetermined angle, wherein the improvement comprises the pivot axis of the printer lever being disposed between the pivot axis and the abutment of the hand lever when it is in its braced position, said printer lever pivot axis being in the closer to of the pivot axis of the hand lever than to the abutment whereby the angle through which the printer rotates is greater than the angle through which the hand lever rotates for a given angle of hand lever rotation, one of the two pivot axes being formed by two disc-like axis members of a first diameter while the other axis is formed by a spindle which is of smaller diameter than said first diameter and arranged radially displaced between the disc-like axis members to connect the latter members.

5. Apparatus according to claim 4 where the printer lever has two lateral limb-walls, which are rigidly interconnected by a connector and which are supported on the two disc-shaped axis members, which are interconnected via the spindle, the hand lever being supported on the spindle.

6. Apparatus according to claim 5 where the abutment face of the printer lever is formed on the connector.

7. Apparatus according to claim 6 where the connector is of Y-shaped cross-section having a limb on which the abutment face of the printer lever is provided.

* * * * *